United States Patent [19]

ter Burg et al.

[11] 4,421,439

[45] Dec. 20, 1983

[54] SUPPORTING FABRIC FOR BEARING BULK MATERIAL AND A METHOD OF BUILDING A ROAD, DIKE OR DAM EMBANKMENT

[75] Inventors: Antonius W. M. ter Burg; Gerrit den Hoedt, both of Arnhem, Netherlands

[73] Assignee: Akzona Incorporated, Asheville, N.C.

[21] Appl. No.: 180,785

[22] Filed: Aug. 25, 1980

[30] Foreign Application Priority Data

Sep. 3, 1979 [NL] Netherlands ..... 7906585

[51] Int. Cl.[3] ..... E02D 5/00

[52] U.S. Cl. ..... 405/258; 139/415; 405/16; 405/262

[58] Field of Search ..... 405/258, 270, 262, 271, 405/15–20; 139/415; 404/82, 18

[56] References Cited

U.S. PATENT DOCUMENTS

| | | | |
|---|---|---|---|
| 1,363,690 | 12/1920 | Sullivan | 405/270 X |
| 1,582,415 | 4/1926 | Manley | 139/415 |
| 1,969,267 | 8/1934 | Hubbard | 404/82 X |
| 3,446,252 | 5/1969 | Maxham | 139/415 X |
| 3,717,366 | 5/1967 | Dionne . | |
| 3,925,994 | 12/1975 | Broms et al. | 405/258 |

FOREIGN PATENT DOCUMENTS

| | | |
|---|---|---|
| 2000937 | 7/1971 | Fed. Rep. of Germany . |
| 2053891 | 5/1972 | Fed. Rep. of Germany . |
| 2626650 | 12/1977 | Fed. Rep. of Germany . |
| 2214001 | 1/1973 | France . |
| 2388090 | 4/1978 | France . |
| 6405171 | 11/1964 | Netherlands . |
| 7007249 | 7/1971 | Netherlands . |
| 1447742 | 8/1976 | United Kingdom . |

OTHER PUBLICATIONS

"Synthetic Woven Fabrics in Practice" by J. H. van Leeuwen, Land+Water International, No. 29, Spring 1976, p. 15.

"Cotton-Fabric-Reinforced Roads" by W. K. Beckham et al., Engineering News-Record, Oct. 3, 1935, pp. 453–455.

Article (title unknown) from Engineering News--Record, Feb. 17, 1938, p. 272.

*Primary Examiner*—Dennis L. Taylor

*Attorney, Agent, or Firm*—Francis W. Young; Jack H. Hall

[57] ABSTRACT

The invention relates to a supporting fabric having a width of at least 30 cm, and preferably more than 2–5 m, and containing warp and weft yarns of a synthetic material, for bearing one or more layers of sand, gravel, stones, clay, loam or similar bulk or other material to a height of at least 10 cm, which height is in actual practice often 5–15 m. The yarns extending in the warp direction of the fabric are formed by straight warp yarns and binder warp yarns, the straight warp yarns each having a higher strength than the binder warp yarns.

The invention also comprises a method for building a road embankment, a dike, a dam, or some other structure formed from bulk material, such as, for instance, sand, gravel or stones. In such a structure, one or more layers of supporting fabric are incorporated.

17 Claims, 6 Drawing Figures

SUPPORTING FABRIC FOR BEARING BULK MATERIAL AND A METHOD OF BUILDING A ROAD, DIKE OR DAM EMBANKMENT

The invention relates to a supporting fabric containing two different warp yarns, which may be of a synthetic material, for bearing one or more layers of sand, gravel, stones, clay, loam, or other bulk material. The invention also relates to a method of building a road embankment, a dike, a dam or some other structure formed from bulk material, such as, for instance, sand, gravel or stones.

BACKGROUND OF THE INVENTION

A supporting fabric of the type indicated above is known from, for instance, the article "Kunststofweefsels in practijk" by Ir. J. H. van Leeuwen in "Land+Water", No. 7/8, 1975 and from U.S. patent application serial No. 824,083, filed May 13, 1969, now abandoned. These known fabrics are often successfully used in building a road, dam or dike embankment on a subsoil having a low bearing capacity. On such bad subsoil, there is laid a supporting fabric on which subsequently a structure of sand, stones, clinker or other bulk material is formed. The bulk material structure of embankment may vary widely according to the locality and the structure to be made, for example, simple road surfacing, a motorway, a dike or a breakwater in the sea. For instance, the height of the layer of bulk material may range from about twenty cm to 10–20 m. The use of a supporting fabric on a subsoil leads to permanent stability of the raised structure and a proper, permanent separation between the subsoil and the raised structure. Furthermore, the load distribution effect of the supporting fabric consists in a reduction of point-to-point differences in consolidation, so that a re-distribution of stresses is obtained. The use of the known supporting fabric as a soil stabilizing means consequently leads to considerable savings, compared with the conventional method of working without the use of this type of soil stabilizing means. It may be generally stated that the supporting fabric has a stabilizing function, with the fabric being subjected mainly to a tensile load. The warp filaments in the known supporting fabric therefore have a high tensile strength and a limited elongation at break. The known supporting fabric has the disadvantage, however, that in addition to the elongation of the warp yarns, there occurs a fabric elongation which is due to crimp or contraction of the warp yarns. This fabric elongation particularly constitutes a problem as higher demands are made on the load to be taken up by the supporting fabric, particularly because in the case of the supporting fabrics previously used, the fabric elongation in proportion to the elongation of the warp yarns increases as heavier and stronger fabrics are employed. Another disadvantage to the known supporting fabric is that, upon being loaded, it is subject to transverse contraction, as a result of which its width is considerably reduced.

Netherlands Patent Application No. 64 05 171 describes a method of protecting dike structures in such a way that the embankment is reinforced by building in or covering with a netting of some synthetic material. The netting material to be used for it is obtained by weaving, knotting or using the Raschel method. This Netherlands Patent Application does not disclose or suggest the use of a supporting fabric comprising a straight warp, a binder warp and a weft.

According to German Offenlegungsschrift 2,000,937, the warp yarns of a reinforcing fabric are wrapped with threads to prevent the meshes from becoming smaller. The woven fabrics described in said patent application are destined for reinforcing bituminous sheet material. To achieve this end, the fabric must be particularly wide-meshed to permit the passage of the bituminous material through the meshes.

French Patent Specification No. 2,388,090 describes a knitted soil consolidation fabric, which has a lower bearing capacity than a woven fabric. Moreover, in the case of a knitted fabric, a less flexible construction is obtained, for in the manufacture of a knitted fabric with a straight warp and a binder wrap, the required amount of binder warp yarn is three times as high as that in the case of a woven fabric.

In British Patent No. 1,447,742, a method is described of reinforcing a foundation with the aid of a network comprising a system consisting of parallel threads of synthetic or glass fiber material and a system of parallel bands crossing and being connected to said system of threads. The parallel threads have a greater strength than the fibers of the system of bands. The stronger threads being regarded as warp threads, the binder warp threads of the present invention are not provided, which results in the above-described disadvantages. Further, the fabric according to said publication has fairly large meshes, so that these known fabrics are less suitable for use in earth filling structures.

In French Patent No. 2,214,001, a fabric is described for reinforcing objects of rubber. A separate thread is wound around the warp threads in such a way that the meshes are kept sufficiently large for the rubber compounds on either side of the fabric to be in contact with each other.

In German Offenlegungsschrift No. 2,053,891, a method is described of reinforcing a dam of sand or stones by the incorporation into it of loose flexible threads of some synthetic material.

Dutch Patent No. 7,007,249 describes a road or dike embankment covered with an asphalt layer. In this asphalt layer, or just underneath it, there is placed some commonly used reinforcing fabric of synthetic fibers.

DESCRIPTION OF THE INVENTION

The invention has, for its object, to provide such a supporting fabric of the type mentioned in the opening paragraph which does not have the disadvantage of unduly high fabric elongation. The supporting fabric according to the invention is characterized in that the yarns extending in the warp direction of the fabric are formed by straight warp yarns and binder warp yarns, the straight warp yarns each having a higher strength than the binder warp yarns, the construction being such that when the fabric is subjected to a tensile load in the warp direction, the straight warp yarns bear a higher proportion of the tensile load than the binder warp yarns, preferably at least 80% of the tensile load. Unexpectedly, it has been found possible for the supporting fabric construction of the type according to the invention to be used for obtaining heavy or even very heavy fabrics having a fairly low fabric elongation. The supporting fabric according to the invention is advantageously characterized in that the linear density of each of the straight warp yarns is at least five times, and preferably ten to forty times as high as the linear density of the binder warp yarns. A preferred construction of the supporting fabric has from 2 to 15 straight warp yarns per cm, and 2 to 15 binder warp yarns per cm viewed in the weft direction, and between successive straight warp yarns or groups of straight warp yarns there are one, two, three or more binder warp yarns. Use of straight warp yarns having a tensile strength of at least 0.2 kilo Newtons (hereafter kN), and preferably 1 to 10 kN, results in a supporting fabric having tensile strengths of more than 200 kN/m, and preferably from 350 to 1250 kN/m in the warp direction, and elongations at break of a strip of the fabric under a tensile load of up to 15%, and preferably 1–15%. In a preferred construction of the supporting fabric, each of the straight warp yarns is composed of a number of constituent yarns that may optionally be twisted together with 60 turns per meter, for example. The constituent yarns themselves may be untwisted or may have a draw-twist of about 10 turns per meter. Although as a result of the additional use of binder warp yarns, the supporting fabric might be expected to be more intricate and expensive, the increased stability of the supporting fabric, due primarily to the virtual absence of any transverse contraction, more than offsets such disadvantages. The construction obtained with the supporting fabric according to the invention displays a higher dimensional stability than previously known fabrics. Favorable results are obtained with a supporting fabric in which the straight warp yarns are each formed of polyester, more particularly polyethylene terephthalate. Favorable results may, however, also be obtained with the use of synthetic yarns of other materials, such as polyamide, polypropylene, polyethylene or aramids. A preferred embodiment of the supporting fabric incorporates straight warp yarns, each of which are built up of 10–30 constituent yarns, each having a linear density of 700–3,000 decitex, preferably 1100 decitex, and 100–500 filaments, preferably about 200. The supporting fabric, according to the invention, may have 2–10 weft yarns per cm, viewed in the direction of the warp, and each of the weft yarns may have a linear density of 1,000–10,000 decitex. Said straight warp yarns and binder warp yarns may be formed by multifilament yarns, monofilament yarns, flat yarn or split fibers. The straight warp and binder warp yarns and the weft yarns of a supporting fabric according to the invention may be of the same material or of different materials. For instance, the warp yarns may be of polyester and the weft yarns of polypropylene.

A supporting fabric bearing one or more layers of sand, gravel, stones, clay, loam or like bulk or other material is particularly suitable for use on the bottom of the sea if one side of the supporting fabric is provided with a number of spaced transverse partitions, at intervals of preferably 0.25 to 3 m, which are formed by a mat, a sheet of netting, a web or a cloth having a height of 10 to 100 cm, the partitioned spaces filled with bulk material being covered at the top and the sides, preferably with a cloth. In a particularly effective construction using the supporting fabric of the invention, the supporting fabric is provided with transverse partitions and a layer of bulk material which can be rolled up, even when the dimensions of the fabric are, for instance, 10×100 m. The fabric can then be rolled off from a vessel at sea and be deposited in the correct place on the bottom.

Another advantage to the supporting fabric according to the invention is that the binder warp yarns make it possible for the water permeability of the fabric to be satisfactorily maintained at the desired value, which can be selected as desired. This may be realized, for instance, by providing at least two crossing binder warp yarns in the form of cords between each two adjacent straight warp yarns.

The invention also comprises a method of stabilizing soil and/or building a road embankment, a dike, a dam or some other structure formed of bulk or other material, such as, for instance, sand, clay, loam, gravel, clinkers or stones, the supporting fabric according to the invention being laid on a subsoil and, subsequently, one or more layers of bulk material being placed on the supporting fabric. The supporting fabrics provided with transverse partitions and a layer of bulk or other material can also be pre-fabricated. For certain uses, a layer of up to 30–40 cm of loose clay may be dumped onto the cross-partitioned supporting fabric. This layer of loose clay may subsequently be compacted and compressed, for instance, with the aid of rolls, to a watertight layer of a thickness of about 10 cm. Laying the supporting fabric provided with transverse partitions and a layer of clay thus compacted on the bottom of a body of water results in a watertight substrate. Pre-fabricated filter mats can be obtained by providing the cross-partitioned supporting fabric with one or more layers of sand or gravel instead of clay.

In various uses, the supporting fabric according to the invention must be properly water permeable, but the meshes in the material must be dimensioned appropriate to the conditions under which it is to be used, so that no bulk material can pass through them. When the bulk material is in the form of sand, use may be made of meshes measuring, for instance, about 0.1×0.1 mm to 0.5×0.5 mm, depending on the grade limits of the sand.

The following table gives the data on several embodiments of supporting fabrics according to the invention. In the table, the following abbreviations are used in specifying the physical characteristics of the yarns used in the construction: Dtex is the total denier in decitex; Z indicates a "Z" twist has been applied to a single yarn or two or more combined yarns; and S indicates an "S" twist has been applied to a single yarn or two or more combined yarns. E.g., in Example 1, the binder warp yarn is a single nylon yarn of 940 decitex and 140 filaments which have been twisted 180 turns per meter in the "Z" direction. The straight warp yarn in Example 1 is polyester having 12 untwisted single yarns of 1100 decitex and 192 filaments each which have been twisted together with a twist of 60 turns per meter in the "Z" direction. In Example 4, the polyester binder yarn has 3 single "S"-twisted (500 turns per meter) yarn of 940 decitex and 140 filaments each which have been twisted together with a twist of 250 turns per meter in the "Z" direction.

TABLE

| Code | Example 1 Stabilenka 400 | Example 2 Stabilenka 600 | Example 3 Stabilenka 800 | Example 4 Support fabric 400 | Example 5 Support fabric 800 |
|---|---|---|---|---|---|
| Straight warp type | Diolen 850 polyester | Diolen 850 polyester | Diolen 850 polyester | Diolen 850 polyester | Diolen 850 polyester |
| Straight warp No. | dtex 1100 | dtex 1100 | dtex 1100 | dtex 1100 | dtex 1100 |

TABLE-continued

| Code | Example 1 Stabilenka 400 | Example 2 Stabilenka 600 | Example 3 Stabilenka 800 | Example 4 Support fabric 400 | Example 5 Support fabric 800 |
|---|---|---|---|---|---|
| | f192 × 12Z60 | f192 × 18Z60 | f192 × 24Z40 | f192 × 12Z60 | f192 × 24Z40 |
| Binder warp type | Enka nylon 155HRS | Enkalon 400 nylon | Enkalon 400 nylon | Enkalon (nylon) cord | Enkalon (nylon) cord |
| Binder warp No. | dtex 940 f140Z180 | dtex 940 f140Z180 | dtex 940 f140Z180 | dtex 940 f140S500 × 3Z250 | dtex 940 f140S500 × 3Z250 |
| Weft type | Enkalon 540 T nylon | Enkalon 540 T nylon | Enkalon 540 T nylon | polypropylene | Enkalon (nylon) cord |
| Weft No. | dtex 1880 f280 | dtex 1880 f280 | dtex 1880 f280 | dtex 5000 split fiber | dtex 1400 f210 × 2S375 × 3Z175 |
| Warp order | | | | | |
| Straight warp: Binder warp | 1:1 | 1:1 | 1:1 | 2:2 | 1:2 |
| Fabric construction on loom | | | | | |
| Straight warp number of threads/cm | 5 | 5 | 5 | 5 | 5 |
| Binder warp number of threads/cm | 5 | 5 | 5 | 5 | 10 |
| Weft, number of threads/cm | 4½ | 4½ | 4½ | 6.7 | 6 |
| Weave | 1/1 | 1/1 | 1/1 | composite | composite |
| Cloth mass per cm in grams | 825 | 1209 | 1580 | 1300 | 2597 |
| Straight warp contraction | 1.0% | 0.8% | 2.8% | 0.6% | 2.0% |
| Binder warp contraction | 26% | 24.8% | 27.6% | 32.2% | 68.72% |
| Weft contraction | 1.6% | 3.0% | 3.4% | 1.0% | 0.4% |
| Fabric thickness | 1.6 mm | 1.75 mm | 2.31 mm | 2.8 mm | 4.75 mm |
| Water permeability at gauge pressure of 10 cm $H_2O$ | 11 cm/min | 11 cm/min | 5 cm/min | 90 cm/min | 70 cm/min |
| Tenacity of fabric strip in warp direction | 486 kN/m | 706 kN/m | 932 kN/m | 475 kN/m | 966 kN/m |
| Elongation at break of fabric strip in warp direction | 10% | 11% | 11% | 10% | 12% |

The tenacity and the elongation were determined in conformity with DIN 53 857, but in such a way that first of all, a pre-stretch was applied until the supporting fabric had undergone 1% deformation.

The invention will be further described with reference to the accompanying schematic drawings.

Figure 1:
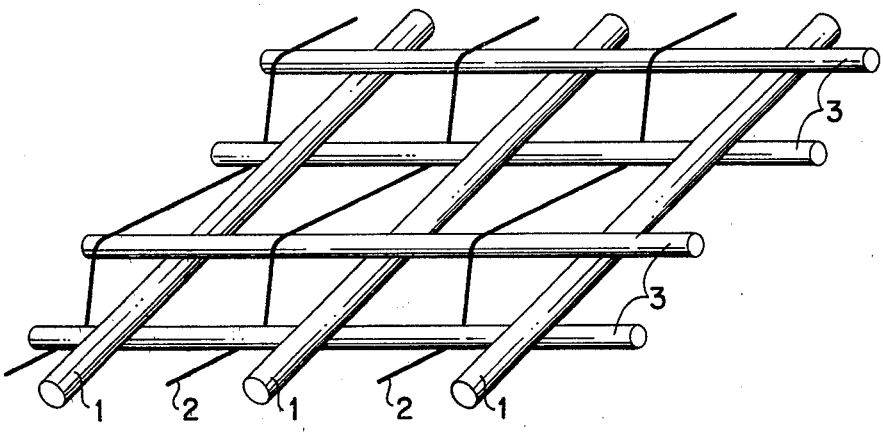
FIG. 1 is a view in perspective of the supporting fabric according to the invention.
Figure 2:
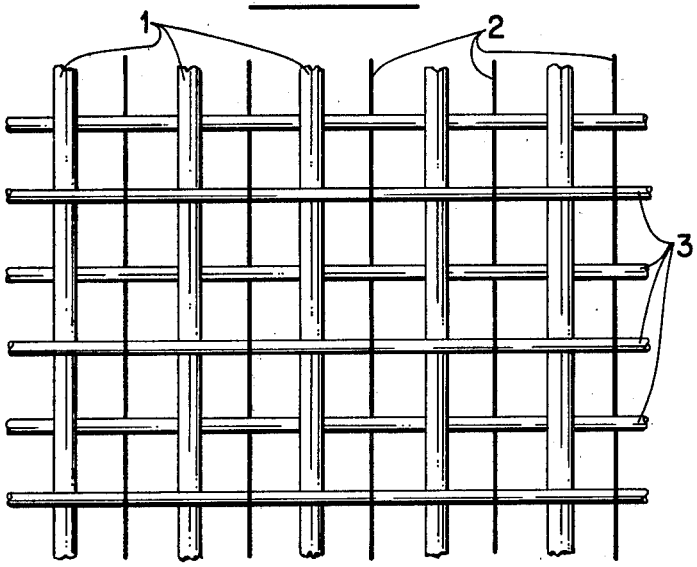
FIG. 2 is a plan view of the fabric according to FIG. 1.
Figure 3:
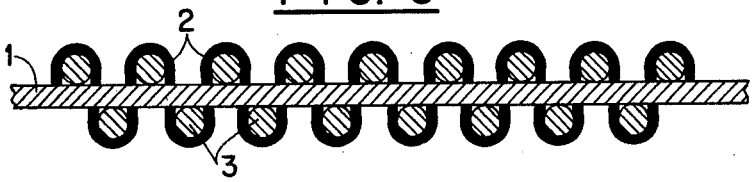
FIG. 3 is a cross-sectional view of the supporting fabric according to the invention.

The supporting fabric shown in FIGS. 1 and 2 has a plain weave pattern, and is formed by straight warp yarns 1, binder warp yarns 2 and weft yarns 3. FIG. 3 shows this fabric in cross-section, like parts being referred to by the same numerals as given in FIGS. 1 and 2. As appears from the drawings, as well as the contraction values given in the Table, the straight warp yarns 1 extend practically rectilinearly in the fabric, whereas the binder warp yarns 2 strongly wind about the weft yarns 3. I.e., the Table shows contractions of less than 3%. Upon being subjected to a tensile load in warp direction, the elongation of the supporting fabric of the invention will consequently be very small. As appears from the drawing and the table, the binder warp yarns show a much higher contraction. The contraction of the binder warp yarns is generally in the range of 25 to 70%.

Figure 4:
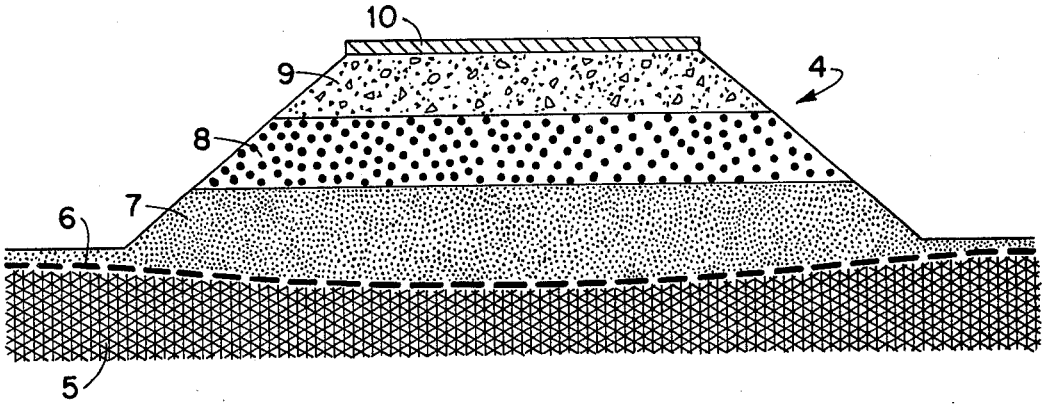
FIG. 4 is a cross-sectional view of a road embankment.

FIG. 4 shows a cross-section of a road embankment 4. The building of a road embankment first of all comprises covering a subsoil of low bearing capacity with a supporting fabric 6 in such a way that the warp direction of the material is transverse to the longitudinal direction of the road embankment. Subsequently, for instance, three different layers of bulk material 7, 8 and 9 are dumped onto the supporting fabric. The top layer 9 is provided in the usual manner with a road surface 10. A supporting fabric 6 thus placed in the foundation of the road embankment has a stabilizing effect until the subsoil has sufficiently consolidated for it to have a higher bearing capacity and may lead to a considerable economy on the cost of building a road. Optionally, a supporting fabric according to the invention may also be placed between any of the boundary surfaces of the three layers of bulk material 7, 8 and 9.

Figure 5:
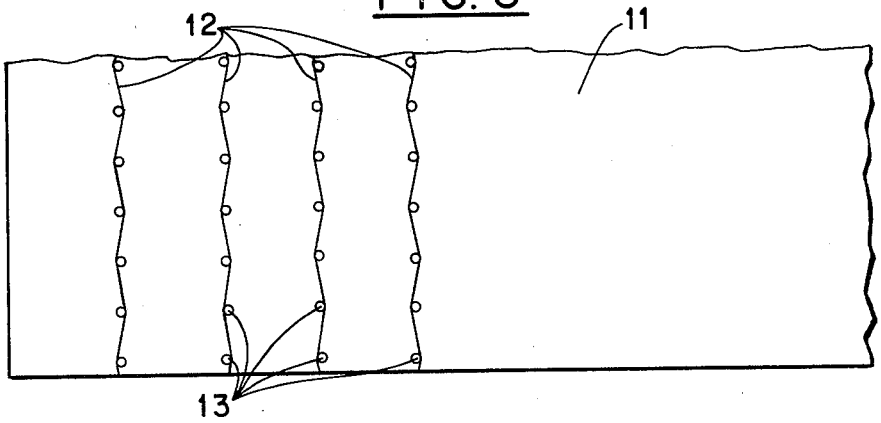
FIG. 5 is a plan view of a supporting fabric according to the invention provided with transverse partitions.
Figure 6:
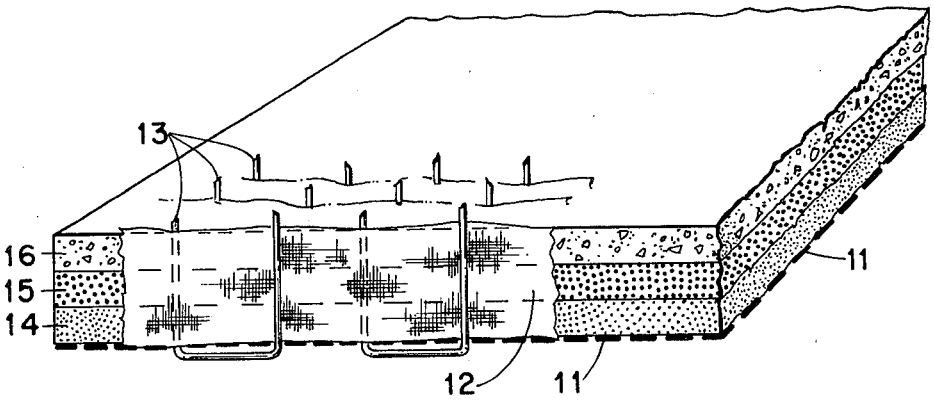
FIG. 6 is a view in perspective of the supporting fabric provided with bulk material as viewed from the left of FIG. 5.

FIGS. 5 and 6 are a plan view and a view in perspective, respectively, of a supporting fabric 11, provided with a large number of transverse partitions 12 which are spaced at 50 cm intervals and have a height of 75 cm. The supporting fabric 11 may measure, for instance, 10×100 m. The transverse partitions 12 preferably consist of synthetic material, and may be formed of a mat, a sheet of netting, a web or a fabric. The partitions 12 may be set up and secured by means of U-shaped supporting brackets or staples 13. However, the partitions 12 also may be attached to the supporting fabric 11 in some other way. The spaces between the partitions are filled up with three layers of bulk material 14, 15 and 16 each having a height of 25 cm as shown in FIG. 6. The particle size of the bulk material increases with increasing vertical height of the layers 14, 15 and 16. The layer 14, for instance, consists of fine sand, whereas the layer 15 consists of coarse sand. The top layer 16, for instance, consists of gravel. The entire filter mat thus formed, i.e., the supporting fabric 11 with transverse partitions 12 and bulk materials 14, 15 and 16, may be covered at the top and at the sides with a cloth (not shown). After its manufacture, the complete filter mat of 10×100 m can be rolled up.

Next, the filter mat may be unrolled and placed in a desired place on the bottom of the sea.

We claim:

1. A supporting fabric having a width of at least 30 cm, and containing warp and weft yarns of a synthetic material, for bearing one or more layers of sand, gravel, stones, clay, loam or similar bulk or other material to a height of at least 10 cm, wherein the yarns extending in the warp direction of the fabric consist of straight warp yarns having a tensile strength of at least 0.2 kN and binder warp yarns, said straight warp yarns each having a higher strength than and at least five times the linear density of said binder warp yarns, the construction being such that when the fabric is subjected to a tensile load in the warp direction, the straight warp yarns bear a higher proportion of the tensile load than the binder warp yarns.

2. The supporting fabric of claim 1, in which said fabric has from 2 to 15 straight warp yarns per cm, and from 2 to 15 binder warp yarns per cm, viewed in weft direction.

3. The supporting fabric of claim 2, wherein between successive straight warp yarns or groups of straight warp yarns, there are one or more binder warp yarns.

4. The supporting fabric of claim 1, wherein said tensile strength is from 1 to 10 kN.

5. The supporting fabric of claim 1, wherein the tensile strength of a strip of the fabric under a tensile load in warp direction is at least 200 kN/m and the elongation at break is less than 15%.

6. The supporting fabric of claim 5, wherein said tensile strength and elongation at break are 350–1250 kN/m and 1–15%, respectively.

7. The supporting fabric of claim 1, wherein each of said straight warp yarns is composed of a number of constituent yarns.

8. The supporting fabric of claim 1, wherein each of said straight warp yarns are formed from the group consisting of polyester, polyamide, polypropylene, polyethylene and aramids.

9. The supporting fabric of claim 7, wherein each of said straight warp yarns are built up of 10–30 constituent yarns, each of which have a linear density of 700–3000 decitex, and 100–500 filaments.

10. The supporting fabric of claim 9, wherein said linear density is about 1100 dtex and said number of filaments is about 200.

11. The supporting fabric according to claim 1, wherein said straight warp yarns are polyethylene terephthalate.

12. The supporting fabric of claim 2, having 2–10 weft yarns per cm, viewed in the direction of the warp, each of said weft yarns having a linear density of 1,000–10,000 decitex.

13. The supporting fabric of claim 1, wherein said straight warp yarns bear at least 80% of the tensile load in the warp direction of said fabric.

14. The supporting fabric of claim 1, wherein said supporting fabric is provided on one side with a number of spaced transverse partitions, consisting of sheets of synthetic material in the form of a mat, web or fabric, at intervals of 0.25 to 3 m, having a height of 10 to 100 cm, said space between said spaced transversed partitions being filled with one or more layers of bulk material.

15. The supporting fabric of claim 14, wherein the particle size of the bulk material increases with increasing vertical height.

16. The supporting fabric of claim 1, wherein the mesh openings in the fabric are so dimensioned that they do permit the passage of water, but do not permit the passage of the particles of bulk or other material placed on the fabric.

17. The supporting fabric of claim 16, wherein said mesh openings are from 0.1×0.1 mm to 0.5×0.5 mm.

* * * * *